US005186703A

United States Patent [19]

Huang

[11] Patent Number: 5,186,703

[45] Date of Patent: Feb. 16, 1993

[54] WALK EXERCISING FLOOR

[76] Inventor: Lien-teng Huang, 9F, No. 63, Sec. 3, Ho-Ping E. Road, Taipei, Taiwan

[21] Appl. No.: 795,143

[22] Filed: Nov. 20, 1991

[51] Int. Cl.[5] ..... A61H 15/00

[52] U.S. Cl. ..... 482/148; 128/60

[58] Field of Search ..... 272/70; 128/60, 25 B, 128/57; 482/23, 49, 148

[56] References Cited

U.S. PATENT DOCUMENTS 4,167,940 9/1979 Ruf ..... 128/25 B
4,329,981 5/1982 Dungl ..... 128/25 B
4,813,405 3/1989 Filip ..... 128/60

FOREIGN PATENT DOCUMENTS 2537870 6/1984 France ..... 128/25 B

*Primary Examiner*—Stephen R. Crow

*Attorney, Agent, or Firm*—Lowe, Price, LeBlanc & Becker

[57] ABSTRACT

A walk exercising floor comprising a base board having a flange vertically projecting upward around the peripheral edge thereof and a recessed surface portion defined within said flange, said recessed surface portion having a plurality of recessed holes thereon, a plurality of stones respectively fastened in said recessed holes, said stones each having a top edge protruding beyond the level of the topmost edge of said flange for massaging the muscles and joints while one is walking, lying or sitting thereon, and a layer of epoxy resin covered over said recessed surface portion in flush with the topmost edge of said flange to secure said stones to said base board. The stones may be manmade, each having holes on the bottom edge thereof into which epoxy resin is filled to secure the stones to the base.

1 Claim, 4 Drawing Sheets

A-A Sec.

WALK EXERCISING FLOOR

BACKGROUND OF THE INVENTION

The present invention relates to walk exercising floors and relates more particularly to a walk exercising floor made from foamed plastics with natural or artificial stones secured in place by an epoxy resin for massaging the muscles and joints while one is walking, lying or sitting thereon.

It has been known that rubbing and kneading the muscles and joints can make them work better, and a thorough massage feels good when one is tired. Walk exercising floor is designed for this purpose. Conventionally, a walk exercising floor is made by inserting stones in a concrete base. This concrete type of walk exercising floor is too rigid. It feels uncomfortable while one is walking thereon. Further, this concrete type of walk exercising floor is not movable. Recently, there have been disclosed several walk exercising floors made from plastic material through the process of injection molding. A walk exercising floor which is made from plastic material can be moved from place to place, however, the convex portions thereon for massaging the muscles are still rigid and do not feel comfortable.

SUMMARY OF THE INVENTION

The present invention has been accomplished to provide a walk exercising floor for massaging the muscles which is movable, and which does not feel uncomfortable.

In an embodiment of the present invention, a walk exercising floor is comprised of a base board made from foamed plastics, which has a plurality of recessed holes on a recessed surface portion surrounded within a raised peripheral edge, a plurality of stones respectively inserted in said recessed holes, and a layer of epoxy resin covered over said recessed surface portion in flush with said raised peripheral edge to secure said stones in place.

In an alternate form of the present invention, artificial stones are fastened in the recessed holes on the base floor and secured in place by a layer of epoxy resin. Each artificial stone comprises a unitary, hollow, cylindrical stub rod vertically extending downward from an elliptic body for inserting in either recessed hole on the base, which cylindrical stub rod has an annular groove around the peripheral surface thereof, and a crossed groove on the bottom edge thereof. While covering an epoxy resin over the recessed surface portion of the base board, the epoxy resin will fill in the annular groove and the gap inside the hollow body of each artificial stone.

In still another alternate form of the present invention, artificial stones are detachably inserted in a plurality of recessed holes on the top of a base board which is made from foamed plastics. In this arrangement, artificial stones can be fastened in the base board according to the desired density and pitch.

BRIEF DESCRIPTION OF THE DRAWINGS

FIG. 6-1 is a cross section taken on line A—A of FIG. 6;

DETAILED DESCRIPTION OF THE PREFERRED EMBODIMENTS

Figure 1:
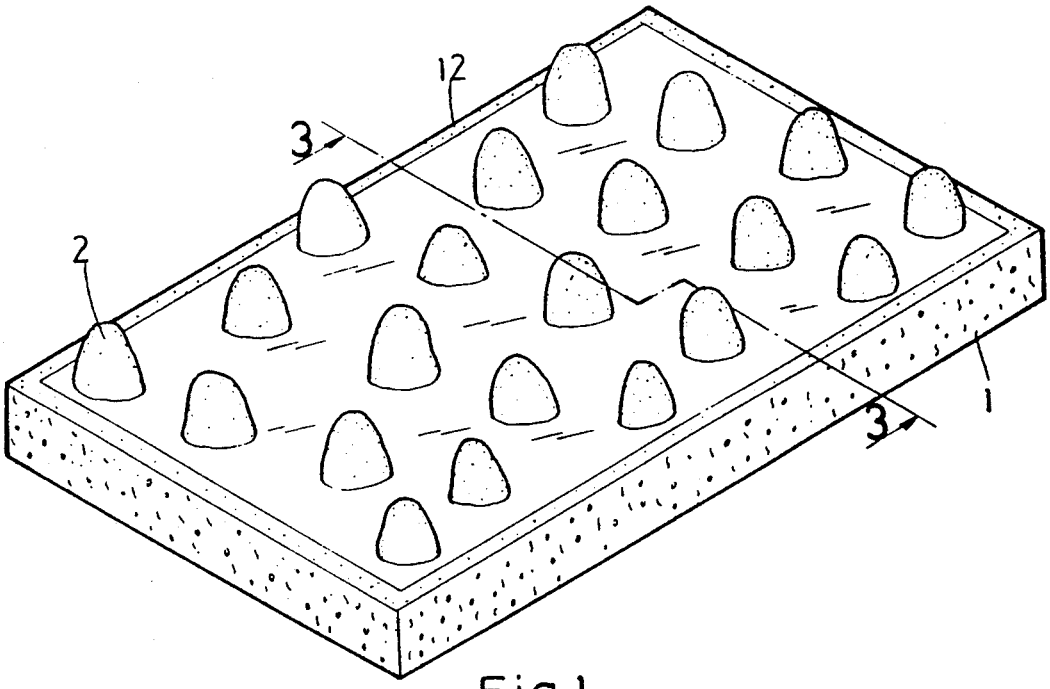
FIG. 1 is an elevational view of a walk exercising floor embodying the present invention, in which natural stones are fastened in a base board for massaging the muscles and joints.
Figure 2:
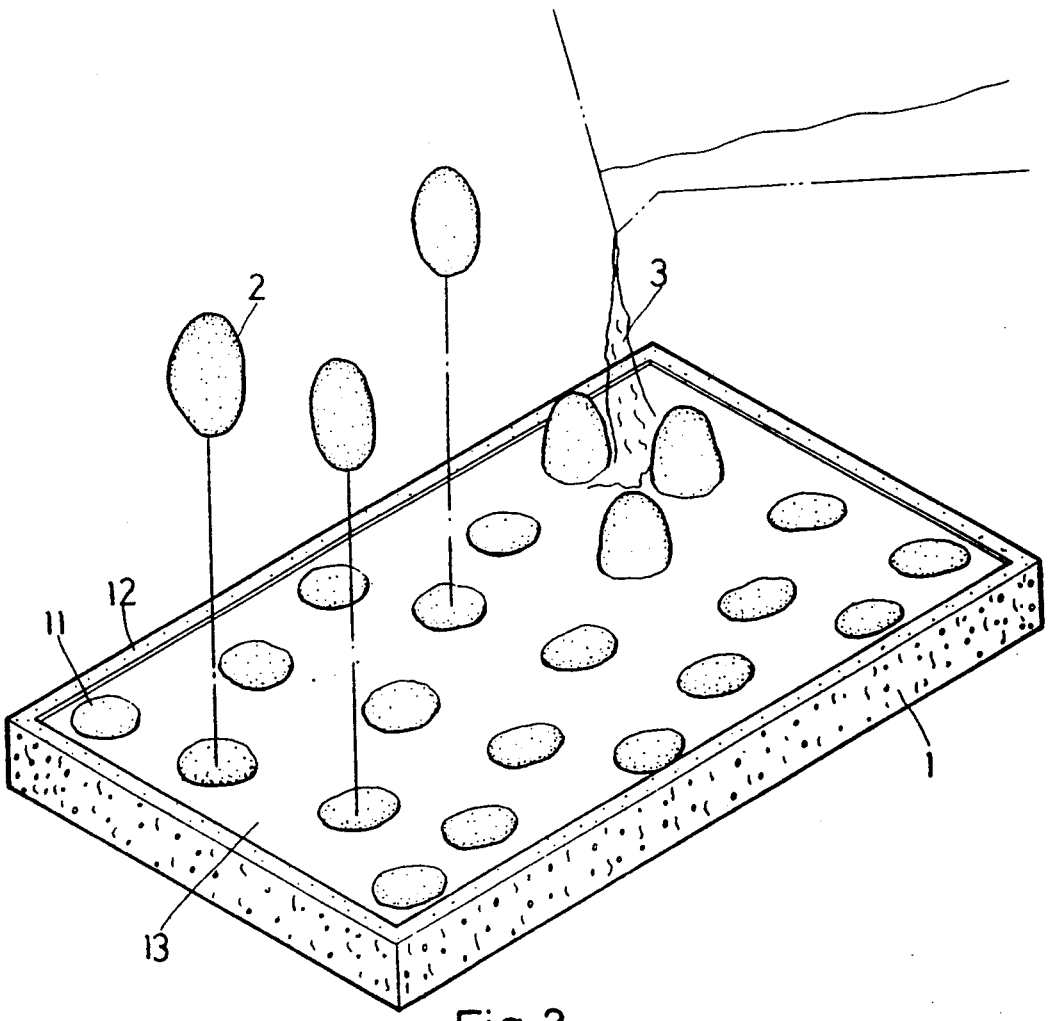
FIG. 2 is a partly exploded view of the walk exercising floor of FIG. 1, showing that an epoxy resin fluid is filled in the recessed surface portion of the base board.
Figure 3:
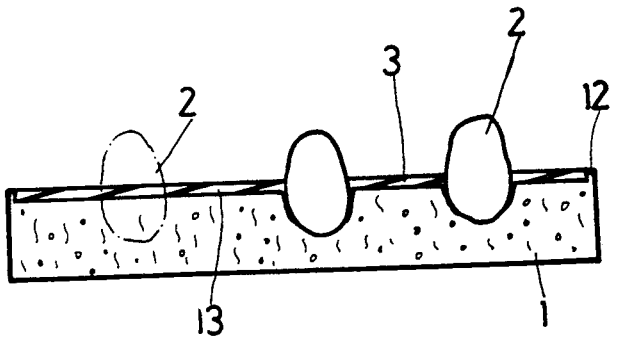
FIG. 3 is a cross section taken on line 3—3 of FIG. 1.
Figure 4:
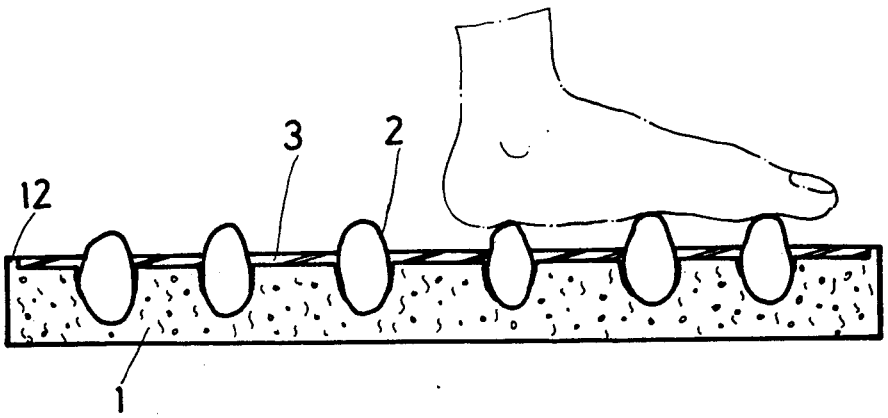
FIG. 4 is a sectional view of the walk exercising floor in longitudinal direction showing that the sole is flexibly supported on the stones.

Referring to FIGS. 1 through 4, a walk exercising floor as constructed in accordance with the present invention is generally comprised of a base board 1 made from foamed plastics in square, rectangular or any of a variety of shapes, and a plurality of natural stones 2. The base board 1 has a flange 12 vertically projecting upward around the peripheral edge thereof, and a plurality of recessed holes 11 on the recessed surface portion 13 thereof, which is defined within said flange 12, for mounting the natural stones 2 respectively. The depth of the recessed holes 11 should be shorter than the length of the natural stones 2 so that the natural stones 2 protrude beyond the level of the topmost edge of the flange 12 when they are inserted in the recessed holes 11. After the stones 2 have been respectively inserted in the recessed holes 11 on the base board 1, an epoxy resin fluid 3 is covered over the recessed surface portion 13 in flush with the topmost edge of the flange 12. After setting of the epoxy resin fluid 3, the natural stones 2 become fixedly secured in the base board 1. By means of the effect of the elastic material property of the foamed plastics and the epoxy resin, the stones 2 will be flexibly squeezed downward and immediately returned back to their original positions while walking. Therefore, one does not feel uncomfortable when walking on the walk exercising floor to massage the soles.

Figure 5:
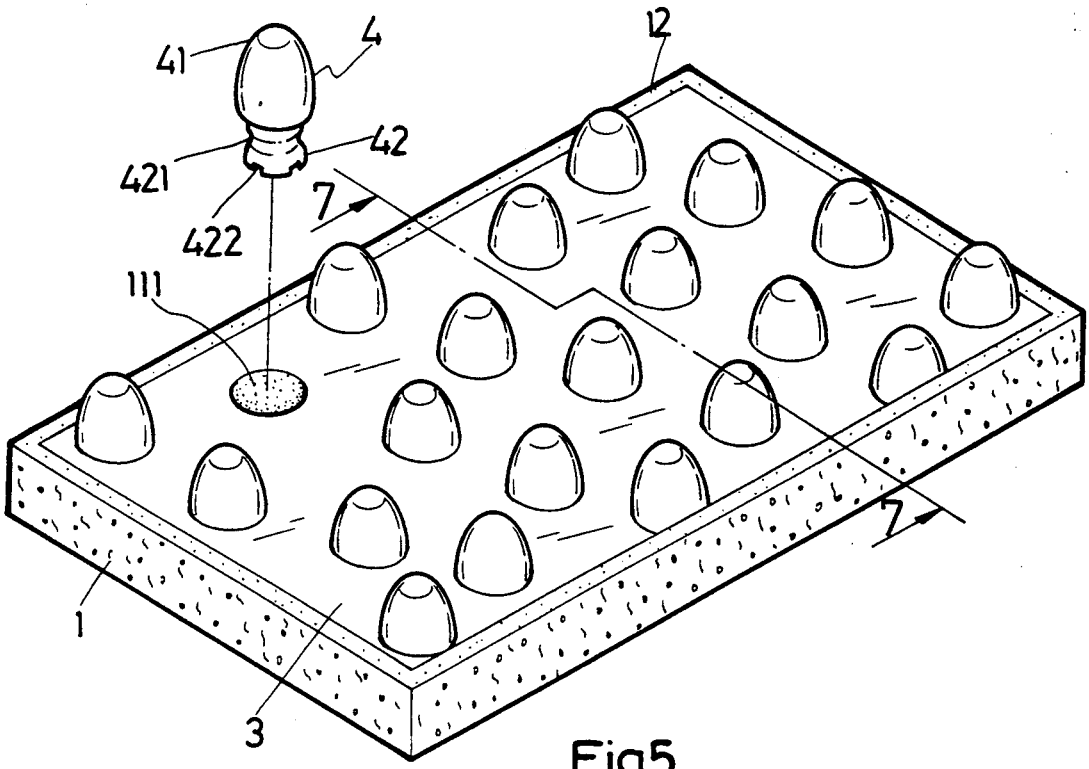
FIG. 5 is an elevational and partly exploded view of an alternate form of the present invention in which artificial stones are fastened in the base board for massaging the sole of the foot.
Figures 1, 6:
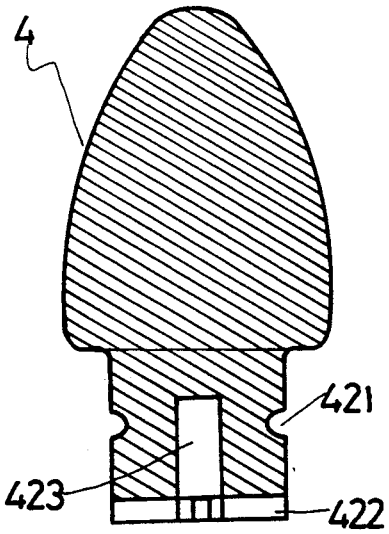
FIG. 6 is a perspective view of an artificial stone according to the present invention.
Figure 6:
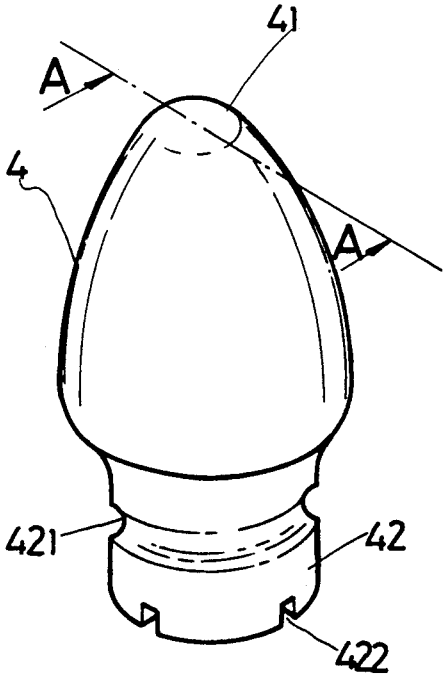
Figure 7:
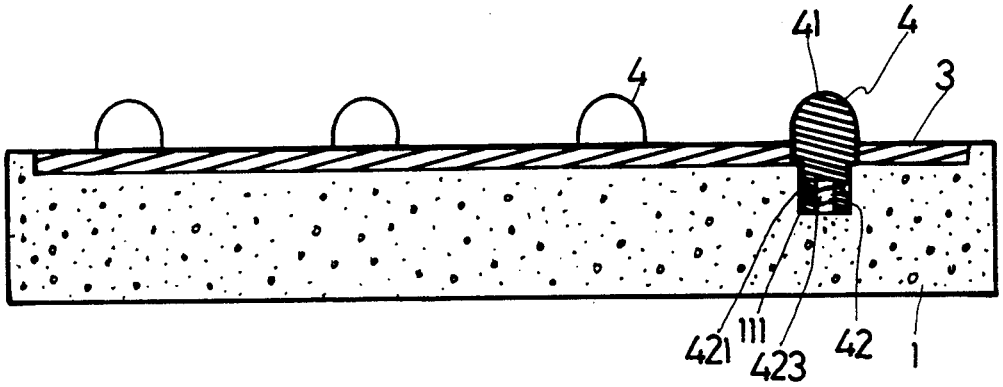
FIG. 7 is a cross sectional taken on line 7—7 of FIG. 5.

Referring to FIGS. 5, 6 and 7, therein illustrated is an alternate form of the present invention. In this embodiment, the structure of the base board remains unchanged, artificial stones are used to replace the natural stones in the aforesaid first embodiment of the present invention. As illustrated in FIG. 5, the base board 1 has a flange 12 around the peripheral edge thereof, and a plurality of circular recessed holes 111 on the recessed surface portion 13 thereof, which is defined within the flange 12, for inserting a plurality of artificial stones 4. After the insertion of the artificial stones 4 in the recessed holes 111 respectively, an epoxy resin fluid is covered over the recessed surface portion 13 in flush with the topmost edge of the flange 12. After setting of the epoxy resin fluid 3, the artificial stones 2 become fixedly secured in the base board 1. As shown in FIGS. 6 and 6-1, each artificial stone 4 comprises a unitary, cylindrical stub rod 42 vertically extending downward from an elliptic body 41. The cylindrical stub rod 42 is made in size tightly fitting the circular recessed holes 111 on the base board 1, having an annular groove 421 around the peripheral surface thereof, a blind hole 423 on the bottom edge thereof in longitudinal direction, and a crossed groove 422 on the bottom edge thereof. When the epoxy resin fluid 3 is filled in the recessed surface portion 13 after the artificial stones 4 having been respectively inserted in the recessed holes 111, the epoxy resin fluid 3 will enter through the crossed groove 422 into the blind hole 423 on each artificial stone 4, and therefore, the artificial stones 4 can be more firmly secured to the base board 1.

Figure 8:
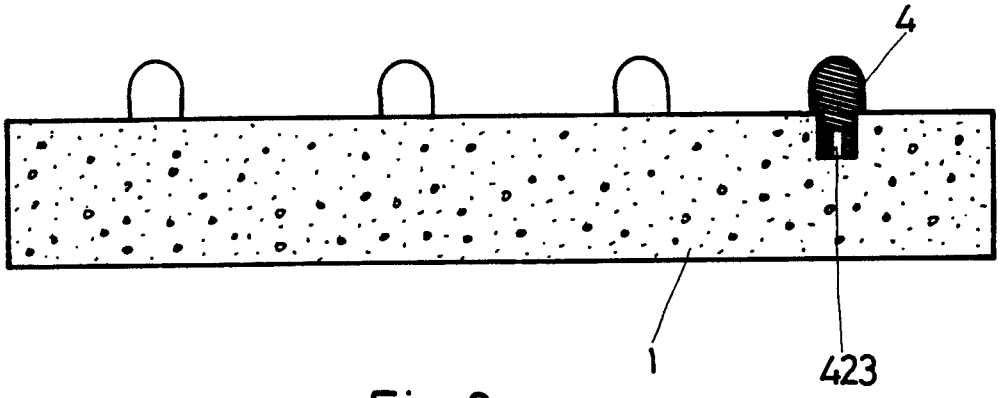
FIG. 8 is a sectional view of another alternate form of the present invention, in which artificial stones can be fastened in the base board according to the desired density and pitch.

Referring to FIG. 8, therein illustrated is still another alternate form of the present invention. In this embodiment, the artificial stones 4 are directly inserted in the base board 1 without the bond of the epoxy resin. In this arrangement, artificial stones 4 can be fastened in the base board 1 according to the desired density and pitch.

Further, several base boards made according to either of the aforesaid embodiments can be connected longitudinally latitudinally forming into an extended size of walk exercising floor for massaging the muscles and joints while one is walking, lying or sitting thereon.

What is claimed is:

1. A walk exercising floor comprising at least one base board made from foamed plastics, said base board having a flange vertically projecting upward around the peripheral edge thereof and a recessed surface portion defined within said flange, said recessed surface portion having a plurality of recessed holes thereon; a plurality of artificial stones respectively fastened in said recessed holes, each of said stones having a top edge protruding above the level of the topmost edge of said flange and having a unitary, cylindrical stub rod vertically extending downward from an elliptic body for inserting in said recessed holes respectively, said cylindrical stub rod having an annular groove around the peripheral surface thereof, a blind hole on the bottom edge thereof in longitudinal direction, and a crossed groove on the bottom edge thereof; and a layer of epoxy resin covered over said recessed surface portion in flush with the topmost edge of said flange to secure said stones to said base board.

* * * * *